US006802436B2

(12) United States Patent
Drennow et al.

(10) Patent No.: US 6,802,436 B2
(45) Date of Patent: Oct. 12, 2004

(54) DISPENSING DEVICE

(75) Inventors: Sten Drennow, Lund (SE); Stefan Cedergren, Bunkeflostrand (SE)

(73) Assignee: Asept International AB, Lund (SE)

( * ) Notice: Subject to any disclaimer, the term of this patent is extended or adjusted under 35 U.S.C. 154(b) by 0 days.

(21) Appl. No.: 10/470,353

(22) PCT Filed: Nov. 19, 2002

(86) PCT No.: PCT/SE02/02094

§ 371 (c)(1),
(2), (4) Date: Nov. 13, 2003

(87) PCT Pub. No.: WO03/051763

PCT Pub. Date: Jun. 26, 2003

(65) Prior Publication Data

US 2004/0065693 A1 Apr. 8, 2004

(30) Foreign Application Priority Data

Nov. 26, 2001 (SE) ..... 0103963

(51) Int. Cl.[7] ..... B67D 5/00

(52) U.S. Cl. ..... 222/82; 222/207; 222/211; 222/214

(58) Field of Search ..... 222/82–83, 105, 222/207, 209, 211, 214

(56) References Cited

U.S. PATENT DOCUMENTS 4,515,294 A * 5/1985 Udall ..... 222/207
4,589,573 A 5/1986 Tada
5,375,746 A 12/1994 Schaefer et al.
5,381,932 A 1/1995 Humphrey
5,452,826 A 9/1995 Stern
5,579,959 A 12/1996 Bennett et al.
5,878,915 A 3/1999 Gordon et al.
6,089,406 A * 7/2000 Feldner ..... 222/105
6,260,736 B1 7/2001 Adams et al.

FOREIGN PATENT DOCUMENTS

| | | |
|---|---|---|
| EP | 0721803 A2 | 7/1996 |
| SE | 444349 | 4/1986 |
| SE | 505827 | 10/1997 |
| WO | WO03051763 A1 | 6/2003 |

* cited by examiner

*Primary Examiner*—Philippe Derakshani
(74) *Attorney, Agent, or Firm*—Tarolli, Sundheim, Covell & Tummino L.L.P.

(57) ABSTRACT

The present invention relates to dispensing device for dispensing portions of liquid foodstuff from a foodstuff container. A pump device (5) includes a pump chamber (10) and a connecting pipe (7) or similar for connecting the foodstuff container (2) to the pump chamber (10) and a pump means (14) forming part of the pump device (5) is designed and can be affected such that said pump means (14) can generate a vacuum in the pump chamber (10), connecting pipe (7) and foodstuff container (2) for drawing foodstuff (4) out of said foodstuff container (2) to the pump chamber (10). At least portions (18) of a through-flow passage (13) for foodstuff (4) in the connecting pipe (7) taper in which the flow direction (S) in which food-stuff (4) flows through said through-flow passage (13). The connecting pipe (7) has an inlet pipe (11) which can be pressed through a flexible wall (3) of the foodstuff container (2) and be connected to a connecting member (21) therein.

15 Claims, 2 Drawing Sheets

DISPENSING DEVICE

The present invention relates to a dispensing device for dispensing portions of liquid foodstuff from a foodstuff container, wherein the foodstuff container can be placed in an outer container, wherein a pump device is removably mounted on the outer container and includes a pump chamber and a connecting pipe or similar for connecting the foodstuff container to the pump chamber, wherein the pump device includes a pump means which is designed such that and which can be affected by a device affecting the pump device such that said pump means can generate a vacuum in the pump chamber, connecting pipe and foodstuff container for drawing foodstuff out of said foodstuff container to the pump chamber and press foodstuff out of the pump chamber and into a dispensing pipe connected thereto, wherein a first non-return valve, seen in the flow direction of the foodstuff through the pump device, is located upstream of the pump chamber and adapted to prevent foodstuff from flowing back from said pump chamber towards the foodstuff container during dispensing of foodstuff from the pump chamber, and wherein a second non-return valve, seen in the flow direction of the foodstuff through the pump device is located downstream of the pump chamber and adapted to prevent foodstuff and/or air from being drawn or sucked into the pump chamber from said dispensing pipe or similar when the pump means draws foodstuff from the foodstuff container to the pump chamber.

Dispensing devices of the above construction are previously known from U.S. Pat. No. 5,452,826. The object of the present invention is to improve the ability of the pump device to pump foodstuff out of the foodstuff container. According to the invention this is arrived at by providing the dispensing device with substantially the characterizing features of subsequent claim 1.

By providing the dispensing device with said characterizing features, the pumping ability of the pump device is improved, which is achieved inter alia by subjecting the foodstuff to less resistance when it is drawn or sucked from the foodstuff container to the pump chamber of the pump device.

Figure 1:
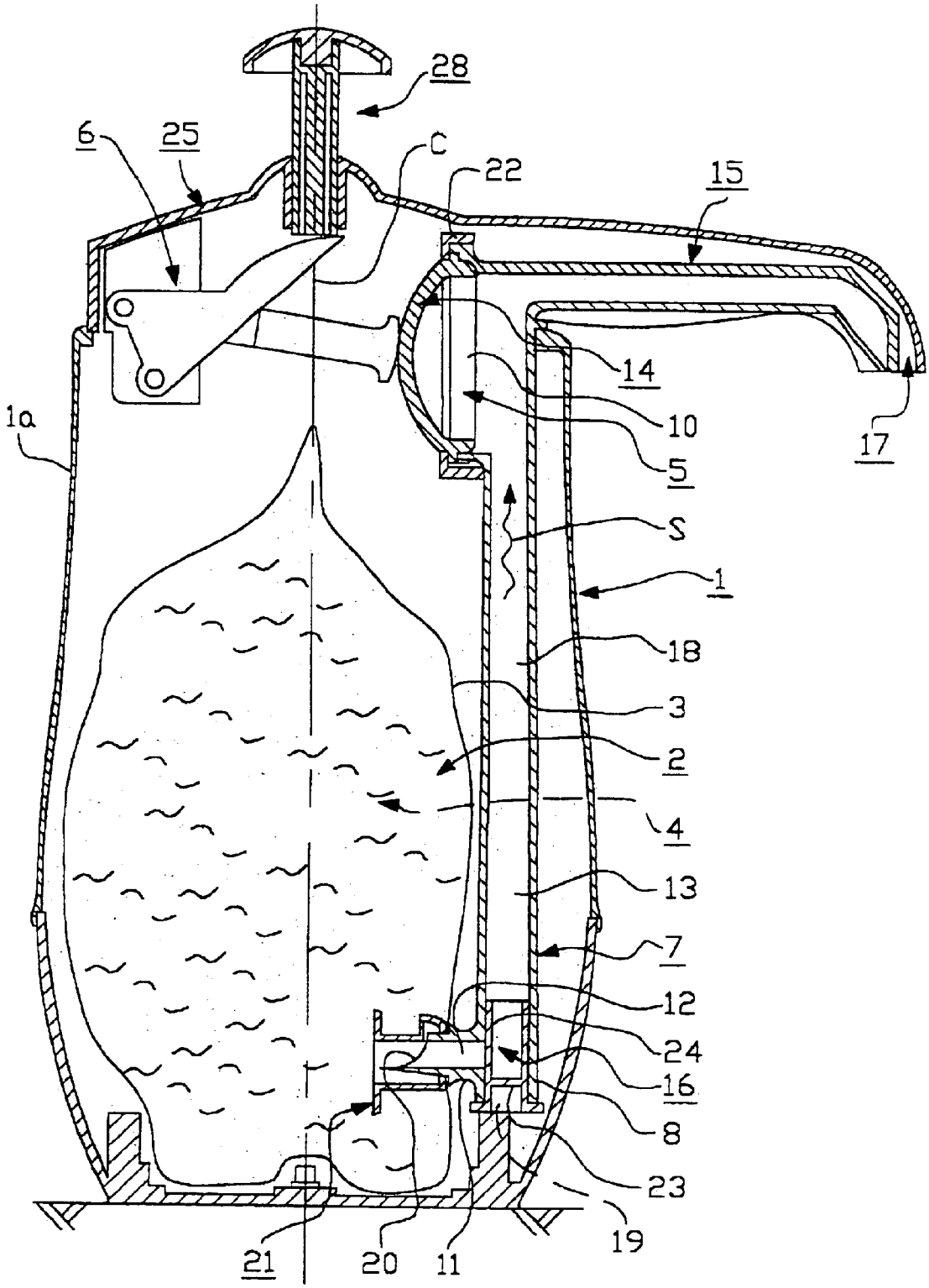
Figure 2:
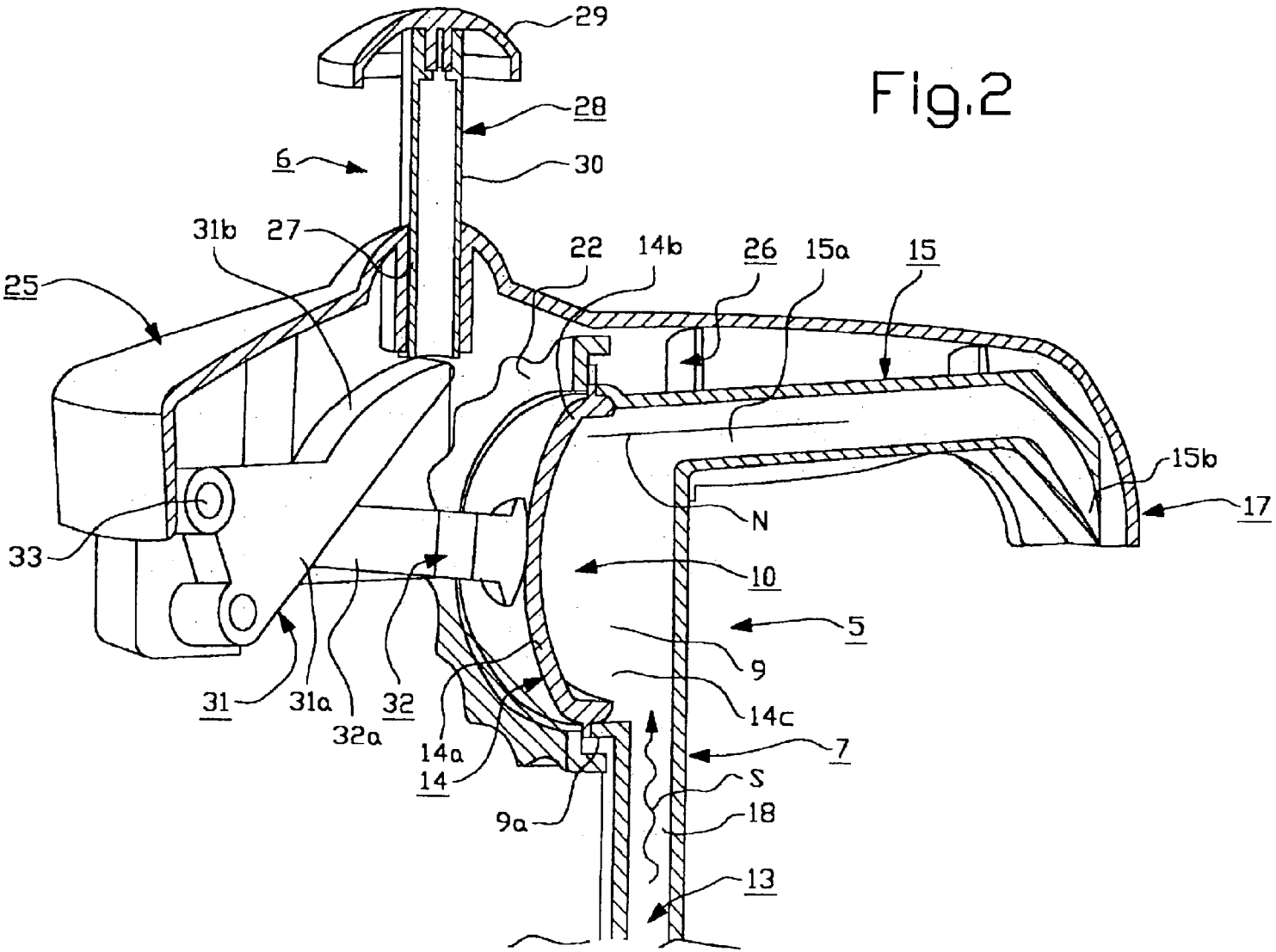

The invention will be further described below with reference to the accompanying drawings, in which FIG. 1 is a longitudinal section of a dispensing device according to the invention; and FIG. 2 is a section of a cap of the dispensing device and of upper members of a pump device forming part of the dispensing device.

The dispensing device illustrated in the drawings comprises an outer container 1 in which a foodstuff container 2 can be placed. The foodstuff container 2 consists of or has walls 3 of flexible material and may e.g. be of the plastic bag type which is contracted by suction if a vacuum is generated therein. The foodstuff container 2 contains liquid foodstuff, e.g. ketchup, mustard, dressing, sauces or similar.

A pump device 5 for drawing foodstuff 4 out of the foodstuff container 2 and dispense or discharge portions thereof at a suitable location is releasably mounted on the outer container 1 such that it is located within said outer container. A device 6 affecting the pump device 5 is provided to affect the pump device 5 such that said pump device 5 performs pump movements.

The pump device 5 includes an elongated connecting pipe 7 or similar, having an openable end portion 8 and being at the opposite end connected to a front portion 9 of a pump chamber 10. The connecting pipe 7 has a laterally directed inlet pipe 11 at the openable end portion 8. A through-flow passage 12 for foodstuff 4 in this inlet pipe 11 connects to a through-flow passage 13 for foodstuff 4 in the connecting pipe 7 and said through-flow passages 12, 13 are adapted to permit flow of foodstuff 4 from the foodstuff container 2 to the pump chamber 10.

A rear part of the pump chamber 10 of the pump device 5 is defined by a pump means 14 having a portion 14*a* with a semi-spherical or substantially semi-spherical normal shape and consisting of such elastic material that it a) by deformation from normal shape, when affected by forces from the affecting device 6, can be brought to perform pump movements in order to press foodstuff 4 out of the pump chamber 10 and out of the pump device 5 through a dispensing pipe 15, and b) by return to normal shape with the affecting forces cease or decrease, can such or draw foodstuff 4 out of the foodstuff container 2 by generating a vacuum in the pump chamber 10, through-flow passages 12, 13 and the foodstuff container 2.

A first non-return valve 16 is provided upstream of the pump chamber 10, seen in the flow direction S of the foodstuff 4, and a second non-return valve 17 is provided downstream of the pump chamber 10, seen in said flow direction S. The first non-return valve 16 is provided to prevent foodstuff 4 from flowing towards the foodstuff container 2 when the pump means 14 pumps out foodstuff 4 from the pump chamber 10, but to let foodstuff 4 pass when it is drawn towards the pump chamber 10. The second non-return valve 17 is provided to let foodstuff 4 pass when it is pumped out of the pump chamber 10 and out through the dispensing pipe 15, but prevent that foodstuff 4 and/or air is drawn into the pump chamber 10 through the dispensing pipe 15 when foodstuff 4 is drawn thereinto from the foodstuff container 2.

In order to improve the pumping ability of the pump device 5, at least portions 18 of the through-flow passage 13 of the connecting pipe 7 taper in the flow direction S of the foodstuff 4. Said tapering portions 18 are preferably straight portions between an end opening 19 in the openable end portion 8 and the pump chamber 10, whereby said straight portions preferably taper conically in their entire length or at least the major part thereof. With this tapering shape of the through-flow passage 13 it is achieved that the flow resistance for foodstuff flowing therethrough is less in passage parts lying closest to the foodstuff container 2 than in passage parts closer to the pump chamber 10. This means that a higher negative pressure or vacuum can be generated in the foodstuff container 2 and through-flow passages 12, 13 than if the through-flow passage 13 does not taper. It will also be possible to more easily clean the connecting pipe 7 through the end opening 19 and also easier to inspect whether said connecting pipe 7 is clean.

The through-flow passage 12 of the inlet pipe 11 may, in its entire length or parts thereof, taper in the flow direction S of the foodstuff 4. The inlet pipe 11 may also have an end portion 20 which is designed for being pressed through the flexible wall 3 of the foodstuff container 2 at a location where a connecting member 21 is found within said wall 3. After having been pressed through the flexible wall 3, said end portion 20 can be pressed into and thereby connected to the connecting member 21 such that the inlet pipe 11 is attached thereto and foodstuff 4 can flow out of the foodstuff container 2 and into the through-flow passage 12 of the inlet pipe 11 and further into the pump chamber 10.

Upper portions 14*b* of the pump means 14 and portions 15*a* of the dispensing pipe 15 protruding outwards from the pump chamber 10, are located preferably at the same or substantially the same level N such that pump means 14 can draw foodstuff 4 to said level N. It is hereby avoided that an air pocket is formed in the pump chamber 10.

The semi-spherical portion 14*a* of the pump means 14 may at the front transcend into an annular portion 14*c* which can engage a seat 9*a* of the front part 9 of the pump chamber 10. A retaining ring 22 can be fixed, e.g. fastened with screws, onto the front part 9 of the pump chamber 10 for sealingly retain the annular portion 14*c* of the pump means 14 against the seat 9*a*.

The first non-return valve 16 may include a sealing or closing member 23 which can be inserted into the openable end portion 8 in the connecting pipe 7 for closing thereof. The first non-return valve 16 may also include a valve member 24 which can be connected to the closing member 23 and which can engage a wall of the through-flow passage 13 of the connecting pipe 7 around an orifice through which the through-flow passage 12 of the inlet pipe 11 opens into the through-flow passage 13 of the connecting pipe 7 for closing said orifice. The valve member 24 is capable of disengaging the wall around said orifice for letting through foodstuff 4 from the through-flow passage 12 of the inlet pipe 11 to the through-flow passage 13 of the connecting pipe 7 when the valve member 24 is affected by a vacuum generated by the pump means 14 in the through-flow passage 13 of the connecting pipe 7.

The second non-return valve 17 can be defined by a front portion 15*b* of the dispensing device 15 and this front portion 15*b* can in a normal shape close the dispensing pipe 15 at the front. Furthermore, the front portion 15*b* may consist of such elastic material that it is opened when the pump means 14 increases the pressure in the dispensing pipe 15 during dispensing or discharge of portions of foodstuff 4 therethrough. Also, the front portion 15*b* can return to closed normal shape when said pressure ceases, whereby the second non-return valve 17 returns to closed position.

At the embodiment illustrated in the drawings the outer container 1 is at the top sealable by means of a cap 25. There may be a snap-in device 26 which allows snap-in attachment of the pump device 5 to said cap 25 such that the pump device 5 can be lowered down into and lifted up and out of the outer container 1 by means of the cap 25.

The outer container 1 is preferably designed as a standing, vertical, cylinder 1*a* with a circular or substantially circular cross section and with substantially the same diameter. This cylinder 1*a* is sealable at the top by means of the cap 25, which preferably has a bearing member 27 which is centered with or substantially centered with an imaginary longitudinal centre line C through the outer container 1. The bearing member 27 is preferably designed as a longitudinal sleeve which is axially directed relative to the centre line C and which is centered or substantially centered therewith. A pump handle 28, forming part of the device 6 affecting the pump device 5, is movable in vertical or substantially vertical direction. The pump handle 28 has at the top a press or push member 29 against which one can press the hand, and a vertically or substantially vertically directed member 30 which is axially movably journalled in said bearing member 27 relative to said centre line C and centered or substantially centered in relation thereto.

The device 6 affecting the pump device 5 includes one or more motion transfer members 31 and/or 32 with which the vertically directed member 30 of the pump handle 28 cooperates such that this or these member(s) 31 and/or 32 transfer pump movements applied on the pump handle 28, to the pump means 14 and vice versa.

The device 6 affecting the pump device 5 is preferably designed such that when depressing the pump handle 28, one has to increase the pressure against said handle 28 in order to perform a pump movement. This function can be performed with different means, e.g. by designing the motion transfer members 31, 32 as shown in the drawings. In the embodiment shown, the member 31 has the shape of a lever 31*a* which is on one side pivotally journalled in the cap 25 in vertical direction through a horizontal shaft 33 and which is pivotable in downwards direction when the pump handle 28 is depressed. The lever 31*a* has a curved surface 31*b* with which the vertically directed member 30 of the pump handle 28 cooperates during depression of the pump handle 28. The lever 31*a* cooperates with the member 32 which has the shape of a rod or fork 32*a* which is slidably journalled in the cap 25, engages the pump means 14 and is provided to perform a horizontal or substantially horizontal movement. The lever 31*a* is pivotally journalled and the curvature of the curved surface 31*b* is designed to provide such changing of the pump movement of the pump handle 28 that the pressure against the pump handle 28 must be increased during depression thereof in order to perform the pump movement.

The lever 31*a* may further be so pivotally journalled and the curved surface 31*b* of the lever 31*a* may have such curvature that the movement of the rod 32*a* decreases successively when it affects the pump means 14 during the pump movement.

When the pump handle 28 is released after pumping, the pump means. 14 returns the pump handle 28 in upwards direction through the members 31 and 32.

Since the pump handle 28 is centered or substantially centered relative to the centre line C of the outer container 1, the press force thereon will also be centered relative to the outer container 1, which means that one prevents the outer container 1 from tipping when the pump handle 28 is depressed or that one at least substantially reduces the risk therefor.

Since one has to increase the pressure against the pump handle 28 during each pump movement, it is accomplished that it feels comfortable to pump and since the movement of the pump handle decreases on the way to the pump means 14 it is achieved that said pump means can operate effectively.

The invention is not limited to the embodiment described above and illustrated in the drawings, but may vary within the scope of subsequent claims. Thus, it should be mentioned that the connecting pipe 7, the front part 9 of the pump chamber 10 and the inlet pipe 11 may be designed in one piece of the same plastic material. The outer container 1 and/or the cap 25 and/or the members 31, 32 may be made of the same plastic material or of another suitable material.

What is claimed is:

1. Dispensing device for dispensing portions of liquid foodstuff from a foodstuff container, wherein the foodstuff container (2) can be placed in an outer container (1), wherein a pump device (5) is removably mounted on the outer container (1) and includes a pump chamber (10) and a connecting pipe (7) or similar for connecting the foodstuff container (2) to the pump chamber (10), wherein the pump device (5) includes a pump means (14) which is designed such that and which can be affected by a device (6) affecting the pump device (5) such that said pump means (14) can generate a vacuum in the pump chamber (10), connecting pipe (7) and foodstuff container (2) for drawing foodstuff (4) out of said foodstuff container (2) to the pump chamber (10), and press foodstuff (4) out of the pump chamber (10) and into a dispensing pipe (15) connected thereto, wherein a first non-return valve (16), seen in the flow direction (S) of the foodstuff (4) through the pump device (5), is located upstream of the pump chamber (10) and adapted to prevent foodstuff (4) from flowing back from said pump chamber (10) towards the foodstuff container (2) during dispensing of foodstuff (4) from the pump chamber (10), and wherein a second non-return valve (17), seen in the flow direction (S) of the foodstuff (4) through the pump device (5), is located downstream of the pump chamber (10) and adapted to prevent foodstuff (4) and/or air from being drawn or sucked into the pump chamber (10) from said dispensing pipe (15) or similar when the pump means (14) draws foodstuff (4) from the foodstuff container (2) to the pump chamber (10), characterized in that at least portions (18) of a through-flow passage (13) for foodstuff (4) in the connecting pipe (7) taper in the flow direction (S) in which foodstuff (4) flows through said through-flow passage (13), that the connecting pipe (7) has an inlet pipe (11) or similar with an end portion (20) which is designed for being pressed through a flexible wall (3) of the foodstuff container (2), and that the inlet pipe (11) is connectable to a connecting member (21) provided inside the foodstuff container (2) such that the inlet pipe (11) is attached to said connecting member (21) and foodstuff (4) can flow out of the foodstuff container (2) and through a through-flow passage (12) in the inlet pipe (11) and the connecting pipe (7) into the pump chamber (10).

2. Dispensing device according to claim 1, characterized in that portions (18) of the through-flow passage (13) of the connecting pipe (7) taper such that the flow resistance for foodstuff (4) is less in those parts of the through-flow passage (13) lying closer to the foodstuff container (2) than those parts of said through-flow passage (13) lying closer to the pump chamber (10).

3. Dispensing device according to claims 1 or 2, characterized in that portions (18) of the through-flow passage (13) of the connecting pipe (7) taper such that the pump means (14) can generate a higher vacuum in the foodstuff container (2) than if said portions do not taper.

4. Dispensing device according to any preceding claim, characterized in that at least those portions (18) of the through-flow passage (13) of the connecting pipe (7) which are located closest to an openable end portion (8) of the connecting pipe (7), taper conically in the same direction as the flow direction (S) of the foodstuff (4) in order to facilitate cleaning and inspection of the through-flow passage (13) of the connecting pipe (7).

5. Dispensing device according to any preceding claim, characterized in that the through-flow passage (13) of the connecting pipe (7) includes a straight portion (18) between an end opening (19) an the openable end portion (8) and the pump chamber (10) and that said straight portion (18), in the entire or major part of its length, tapers successively in the flow direction (S) of the foodstuff (4).

6. Dispensing device according to any preceding claim, characterized in that the inlet pipe (11) is provided directed laterally at an openable end portion (8) of the connecting pipe (7).

7. Dispensing device according to any preceding claim, characterized in that upper portions (14*b*) of the pump means (14) and portions (15*a*) of said dispensing pipe (15) or similar protruding from the pump chamber (10), are located at the same or substantially the same level (N) such that the pump means (14) can suck or draw foodstuff (4) to said level (N), whereby formation of an air pocket in the pump chamber (10) is avoided.

8. Dispensing device according to any preceding claim, characterized in that the pump means (14) defines a rear part of the pump chamber (10) and includes an annular portion (14*c*) which on one side is sealed by a semi-spherical or substantially semi-spherical portion (14*a*), that the semi-spherical portion (14*a*) consists of or comprises elastic material and can be affected by the device (6) affecting the pump device (5) such that said semi-spherical portion (14*a*) is pressed into the pump chamber (10) from a normal shape for pumping foodstuff (4) out of the pump chamber (10) through the dispensing pipe (15), that the semi-spherical portion (14*a*) is provided to return to its normal shape when the influence from the device (6) affecting the pump device (5) ceases, such that a vacuum is generated in the connecting pipe (7) and the foodstuff container (2) for drawing foodstuff (4) from the foodstuff container (2) and through the connecting pipe (7) to the pump chamber (10), that the connecting pipe (7) is connected to a front part (9) of the pump chamber (10), that said front part (9) has a seat (9*a*) for the annular portion (14*c*) of the pump means (14), sealingly engageable by the annular portion (14*c*), and that a retaining ring (22) can be fixed to said front part (9) of the pump chamber (10) for retaining the pump means (14) at the front part (9).

9. Dispensing device according to any preceding claim, characterized in that said first non-return valve (16) includes a sealing or closing member (23) which can be inserted into an openable end portion (8) of the connecting pipe (7) for closing this end portion (8), that the first non-return valve (16) has a valve member (24) which can engage a wall of the through-flow passage (13) of the connecting pipe (7) around an orifice through which a through-flow passage (12) in the inlet pipe (11) opens into the through-flow passage (13) of the connecting pipe (7) for closing this orifice, and that the valve member (24) is capable of disengaging the wall around said orifice for letting through foodstuff (4) from the through-flow passage (12) of the inlet pipe (11) to the through-flow passage (13) of the connecting pipe (7) when the valve member (24) is affected by a vacuum generated by the pump means (14) in the through-flow passage (13) of the connecting pipe (7).

10. Dispensing device according to any preceding claim, characterized in that said second non-return valve (17) is defined by a front portion (15*b*) of the dispensing device (15), that the front portion (15*b*) closes the dispensing pipe (15), that the front portion (15*b*) consists of such elastic material that it is opened when the pump means (14) increases the pressure in the dispensing pipe (15) during dispensing or discharge of portions of foodstuff (4) therethrough, and that the front portion (15*b*) closes when said pressure ceases, whereby said second non-return valve (17) returns to closed position.

11. Dispensing device according to any preceding claim, characterized in that the outer container (1) is at the top sealable by means of a cap (25) and that a snap-in device (26) is provided for snap-in attachment of the pump device (5) to said cap (25) such that the pump device (5) can be lowered down into and lifted up and out of the outer container (1) by means of the cap (25).

12. Dispensing device for dispensing portions of liquid foodstuff from a foodstuff container, wherein the foodstuff container (2) can be placed in an outer container (1), wherein a pump device (5) is removably mounted on the outer container (1) and includes a pump chamber (10) and a connecting pipe (7) or similar for connecting the foodstuff container (2) to the pump chamber (10), wherein the pump device (5) includes a pump means (14) which is designed such that and which can be affected by a device (6) affecting the pump device (5) such that said pump means (14) can generate a vacuum in the pump chamber (10), connecting pipe (7) and foodstuff container (2) for drawing foodstuff (4) out of said foodstuff container (2) to the pump chamber (10), and press foodstuff (4) out of the pump chamber (10) and into a dispensing pipe (15) connected thereto, wherein a first non-return valve (16), seen in the flow direction (S) of the foodstuff (4) through the pump device (5), is located upstream of the pump chamber (10) and adapted to prevent foodstuff (4) from flowing back from said pump chamber (10) towards the foodstuff container (2) during dispensing of foodstuff (4) from the pump chamber (10), wherein a second non-return valve (17), seen in the flow direction (S) of the foodstuff (4) through the pump device (5), is located downstream of the pump chamber (10) and adapted to prevent foodstuff (4) and/or air from being drawn or sucked into the pump chamber (10) from said dispensing pipe (15) or similar when the pump means (14) draws foodstuff (4) from the foodstuff container (2) to the pump chamber (10), wherein the outer container (1) is sealable at the top by means of a cap (25) including the device (6) affecting the pump device (5) or at least parts or members thereof, wherein a pump handle (28) forms part of the device (6) affecting the pump device (5) and includes a vertically or substantially vertically directed member (30) which is movably journalled in vertical direction in the bearing member (27) in the cap (25) such that the pump handle (28) can be depressed and returned in vertical direction for performing pump movements, and wherein the device (6) affecting the pump device (5) has one or more motion transfer members (31 and/or 32) with which the vertically directed member (30) of the pump handle (28) can cooperate such that this or these motion transfer member(s) (31 and/or 32) transfer pump movements applied on the pump handle (28), to the pump means (14) and vice versa, characterized in that a motion transfer member (31) includes a lever (31*a*) which is pivotally journalled in the cap (25) in vertical or substantially vertical direction and which has a curved surface (31*b*), that the pump handle (28) cooperates with the curved surface (31*b*) and can pivot the lever (31*a*) in vertical or substantially vertical direction during each pump movement.

that the pivoting movement of the lever (31*a*) is transferred to the pump means (14) through at least a member (32) engaging said pump means (14) and vice versa, and that the lever (31*a*) is pivotally journalled and the curvature of the curved surface (31*b*) is designed to provide such changing of the pump movement of the pump handle (28) that the pressure against the pump handle (28) must be increased during depression thereof in order to perform the pump movement.

13. Dispensing device according to claim 12, characterized in that the lever (31*a*) is so pivotally journalled and the curved surface (31*b*) of the lever (31*a*) has such curvature that the movement of a member (32) which can be affected by the lever (31*a*) and which engages the pump means (14), decreases successively when it affects the pump means (14) during a pump movement.

14. Dispensing device according to claims 12 or 13, characterized in that a member (32) which is affected by the lever (31*a*) and which engages the pump means (14), is journalled or mounted at the cap (25) displaceable in horizontal or substantially horizontal direction.

15. Dispensing device according to any of claims 12–14, characterized in that the outer container (1) is designed as a standing, vertical, cylinder (1*a*) with a circular or substantially circular cross section, that the bearing member (27) on the cap (25) is centered or substantially centered with an imaginary longitudinal centre line (C) through the outer container (1), and that the pump handle (28) is centered with the cylinder (1*a*).

* * * * *

UNITED STATES PATENT AND TRADEMARK OFFICE

CERTIFICATE OF CORRECTION

PATENT NO. : 6,802,436 B2
DATED : October 12, 2004
INVENTOR(S) : Sten Drennow and Stefan Cedergren It is certified that error appears in the above-identified patent and that said Letters Patent is hereby corrected as shown below:

Column 5,
Line 40, after "1" delete -- or 2 --.
Lines 45, 53, 60 and 64, after "to" change "any proceeding claim," to -- claim 1 --.

Column 6,
Lines 5, 33, 54 and 65, after "to" change "any proceeding claim," to -- claim 1 --.

Column 8,
Line 34, after "12" delete "or 13".
Line 39, after "of" change "claims 12-14" to -- claim 12 --.

Signed and Sealed this

Twenty-sixth Day of July, 2005

JON W. DUDAS
*Director of the United States Patent and Trademark Office*